US005442830A

United States Patent [19]

Ohm

[11] Patent Number: 5,442,830

[45] Date of Patent: Aug. 22, 1995

[54] FLOOR MOP

[75] Inventor: Heinz J. Ohm, Limburg, Germany

[73] Assignee: Leifheit AG, Lahn, Germany

[21] Appl. No.: 193,792

[22] Filed: Feb. 9, 1994

[30] Foreign Application Priority Data

Feb. 11, 1993 [DE] Germany ..... 43 03 993.6
Dec. 24, 1993 [DE] Germany ..... 43 45 138.1

[51] Int. Cl.[6] ..... A47L 13/253

[52] U.S. Cl. ..... 15/147.2; 15/228; 15/229.8

[58] Field of Search ..... 15/229.4, 229.5, 229.8, 15/229.9, 228, 229.2, 229.3, 229.6, 229.7, 147.1, 147.2, 152

[56] References Cited

U.S. PATENT DOCUMENTS

| | | | |
|---|---|---|---|
| 1,344,936 | 6/1920 | Beaudet | 15/228 |
| 1,618,553 | 2/1927 | Saul | 15/229.8 |
| 2,804,638 | 9/1957 | Vosbikian et al. | 15/229.8 |
| 3,304,567 | 2/1967 | Strum | 15/147.2 |
| 4,312,092 | 1/1982 | Lundgren | 15/228 |
| 4,783,873 | 11/1988 | Young | 15/228 |
| 4,961,242 | 10/1990 | Kress et al. | 15/228 |

FOREIGN PATENT DOCUMENTS

| | | | |
|---|---|---|---|
| 0017208 | 10/1980 | European Pat. Off. . | |
| 461684 | 12/1991 | European Pat. Off. | 15/229.6 |
| 2214879 | 11/1973 | Germany | 15/147.2 |
| 2704417 | 8/1978 | Germany . | |
| 2720622 | 11/1978 | Germany . | |
| 3137791 | 6/1982 | Germany . | |
| 3139245 | 4/1983 | Germany . | |
| 3432685 | 3/1986 | Germany | 15/228 |
| 3935649 | 5/1991 | Germany | 15/147.2 |
| 1604448 | 12/1981 | United Kingdom | 15/147.1 |
| 2209662 | 5/1989 | United Kingdom | 15/228 |

*Primary Examiner*—David A. Scherbel
*Assistant Examiner*—Tony G. Soohoo
*Attorney, Agent, or Firm*—Frishauf, Holtz, Goodman & Woodward

[57] ABSTRACT

A floor mop has a carrier plate (1), on which two U-shaped frame parts (5, 6) are mounted for receiving a removable cover (20), which is provided with flexible plastic parts reinforcing the lengthwise edges. One frame part (6) is pivotably supported in the carrier plate (1) to pivot about a crosswise axis (A). It is held in its extended position by a locking protrusion (11). To pivot the frame part (6) for removing the cover (20), a lever (12) is supported on the carrier plate (1) pivotable about an axis (B, 15). The lever engages the frame part (6) at a point (13) which is located at a distance from the axis (B, 15) and from the lock (11). When the lever (12) is pressed downwardly, e.g. by stepping on it, the frame part (6) is pivoted downwardly and the legs of the U-frame spread, thus overcoming the locking effect of the locking means (11).

24 Claims, 6 Drawing Sheets

FLOOR MOP

Reference to related patent disclosures: German DE-A 31 37 791 German DE-C 31 39 245.

FIELD OF THE INVENTION

The present invention relates to a floor mop, in which a carrier plate is attached by a universal joint to a long handle. The carrier plate has two frame elements coupled thereto which extend beyond the carrier plate, and terminate in essentially U-shaped end portions. A replaceable cover can be slipped over the end portions.

BACKGROUND

In a known floor mop of this type (DE-A 31 37 791), locking and unlocking of the pivotable frame part is done by swiveling the handle. The handle is coupled to a base of the mop by a universal joint. A shaft of the joint surrounds a pivotable frame element. This floor mop is not optimal in its handling, since the handle has to be swiveled 180° in a certain direction in order to unlock the pivotable frame part so that the changeable cover can be removed; in tight spaces, it is virtually impossible to swivel the handle in this way. Moreover, when slipping a new changeable cover onto the mop, if the handle falls over, there is the risk of catching a finger. Finally, this floor mop is expensive to manufacture.

Reference is also made to DE-C 31 39 245. In that floor mop with a changeable cover, the pattern for the cloth cover is designed such that edges, approximately 5 cm wide, are formed on all sides of the receiving face for tensioning frame; these edges are stiffened by being folded over upward and inside and by stitching or adhesive bonding. The intent of this is that the edges will stand upright if the floor mop is moved along baseboards and thus will clean the baseboards along with the floor. This mop, however, does not reach into the corners, that is, the transition from the floor to the baseboard, as can clearly be seen from FIG. 3 of this publication. Moreover, the wide edge creases or folds if the floor mop is pressed against the wall with even slight force. Hence the desired effect of cleaning the baseboard in one operation by moving the edges upward is not attained. Practice has shown that the wide edge, particularly if the cloth cover has already been used often, is a hindrance to proper cleaning in corners and at the edges of the floor.

THE INVENTION

It is an object to create a floor mop of this general type which is extremely simple to handle, permits easy replacement of the changeable cover formed so that its edges rest flat on the floor, has adequate stiffness to prevent folding, creasing and crumpling when it strikes an obstruction, enables reaching even the corner between the floor and the baseboard or wall, and can be readily manufactured at low cost.

Briefly, the carrier for a removable cover has two extending, essentially U-shaped bail-like frame elements, one of which is movable, for pivoting out of an extended position, essentially in alignment with the plane of the other element, to a pivoted position, permitting removal and replacement of the cover. The movable frame element, when the mop is in use, is retained in an extended position, in alignment with the base, by a lock. To pivot the frame element away from this position, a lever is provided, mounted on the base or carrier plate, and forcing the movable frame element over the locking protrusion, by resiliently outwardly deflecting the leg elements, so that the frame element can be pivoted into removal position.

In the floor mop according to the invention, the locking of the pivotable frame part is overcome by simply pivoting the lever, for instance by stepping on it, and at the same time pivoting this frame part out of its extended position so that the changeable cover can be removed or falls off by itself. The lever and the frame parts may be joined to the carrier plate with plug-type connections, which makes for extremely simple manufacture and assembly.

Edge reinforcements formed by elongated flexible plastic parts are provided along the lengthwise edges of the cloth cover; they are preferably retained by folding over the lengthwise edges of the cloth cover and stitching them.

In accordance with another embodiment of the invention, the edge reinforcements are formed by folding over the lengthwise edges twice and stitching them. This obviates the otherwise necessary binding of the edges to prevent raveling.

In both cases, the lengthwise edges of the cloth cover remain in the plane of the floor as the floor mop is guided along a wall or baseboard, and as a result they reach into the corners. The reinforced lengthwise edges should have a width of only 3 cm at most, so that bending upward of the lengthwise edges and crumpling along them is avoided.

Handling and mopping quality at the corners of the cloth cover of the floor mop can be further improved by forming pockets which hold the clamping frames of plastic molded parts which extend into the corners of the cloth cover. These plastic molded parts act as additional edge reinforcements in the corner region. These plastic molding parts may be combined with one of the features described above, but they are effective even on their own and even without additional reinforcement of the lengthwise edge located between the two plastic parts because the lengthwise edges located between the plastic parts can no longer fold or crumple since this region remains taut. Another advantage of these plastic molded parts is that they assist in forming pockets, so that the clamping frame can be introduced without difficulties. It then does not have to be grasped additionally and the user does not need to bend over.

In order for these plastic molded parts not to hinder wringing out of the cloth cover, the edges of these molded parts adjacent to the side edges of the cloth cover may be provided with a cutout, making them approximately U-shaped in plan view.

Both by means of the approximately U-shaped molded parts and by the edge reinforcements provided on the lengthwise edges, which necessarily lead to thickening, easy but very effective wringing out is attained. This is primarily because as the cloth cover is rolled up on both sides, wheel-like disks will form, which are easily grasped in order to wring out the cloth form; thus, strong wringing-out forces can be transmitted.

DRAWINGS

Several exemplary embodiments of the invention are described below, referring to the drawings.

DETAILED DESCRIPTION

Figure 4:
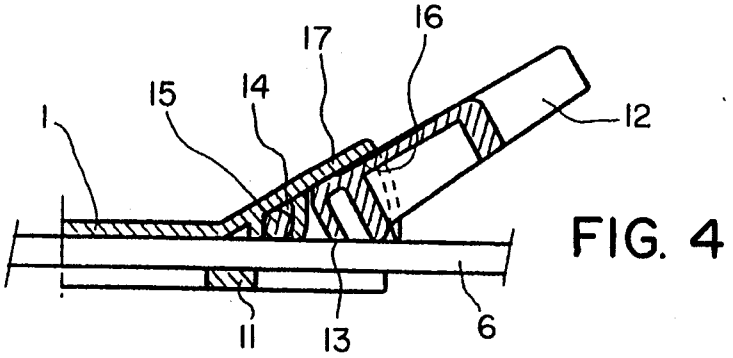
FIG. 4 is a fragmentary section taken along the line IV—IV in FIG. 1.
Figure 1:
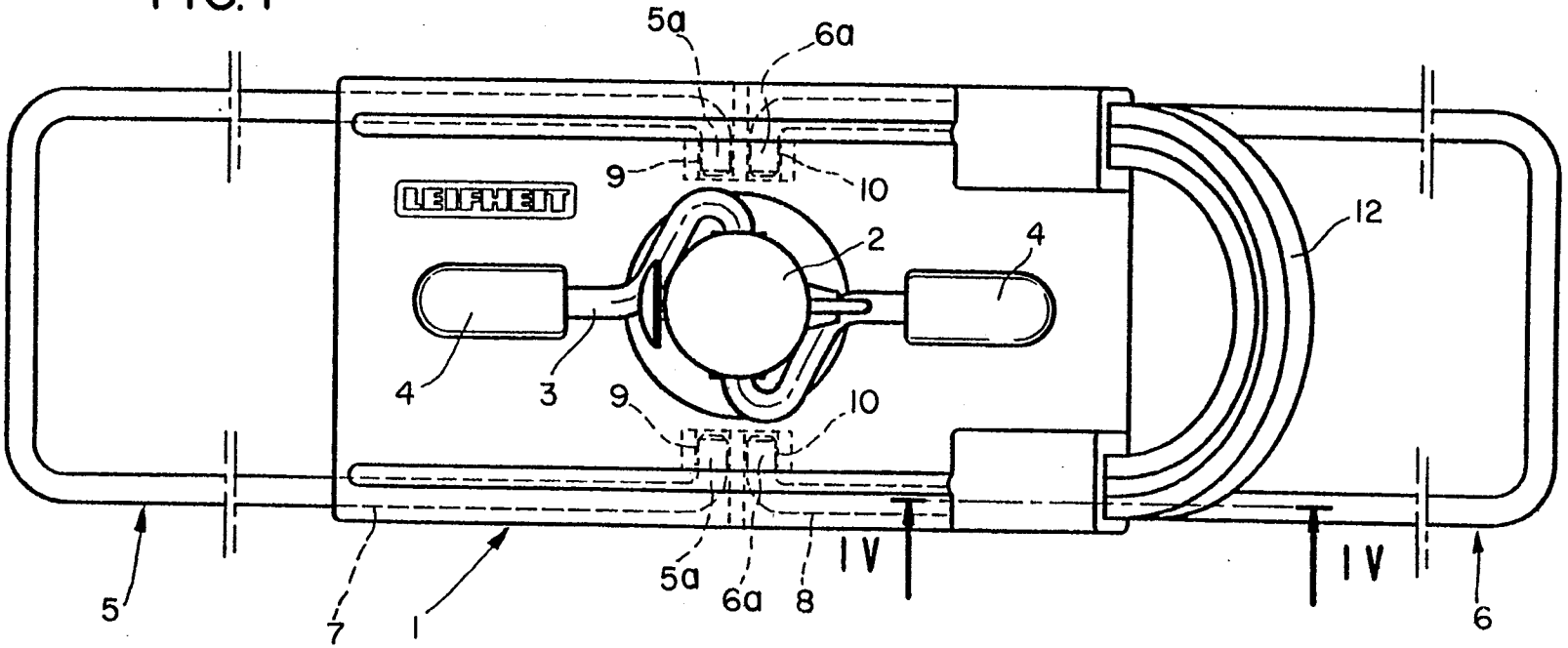
FIG. 1 is a plan view of the floor mop.
Figure 2:
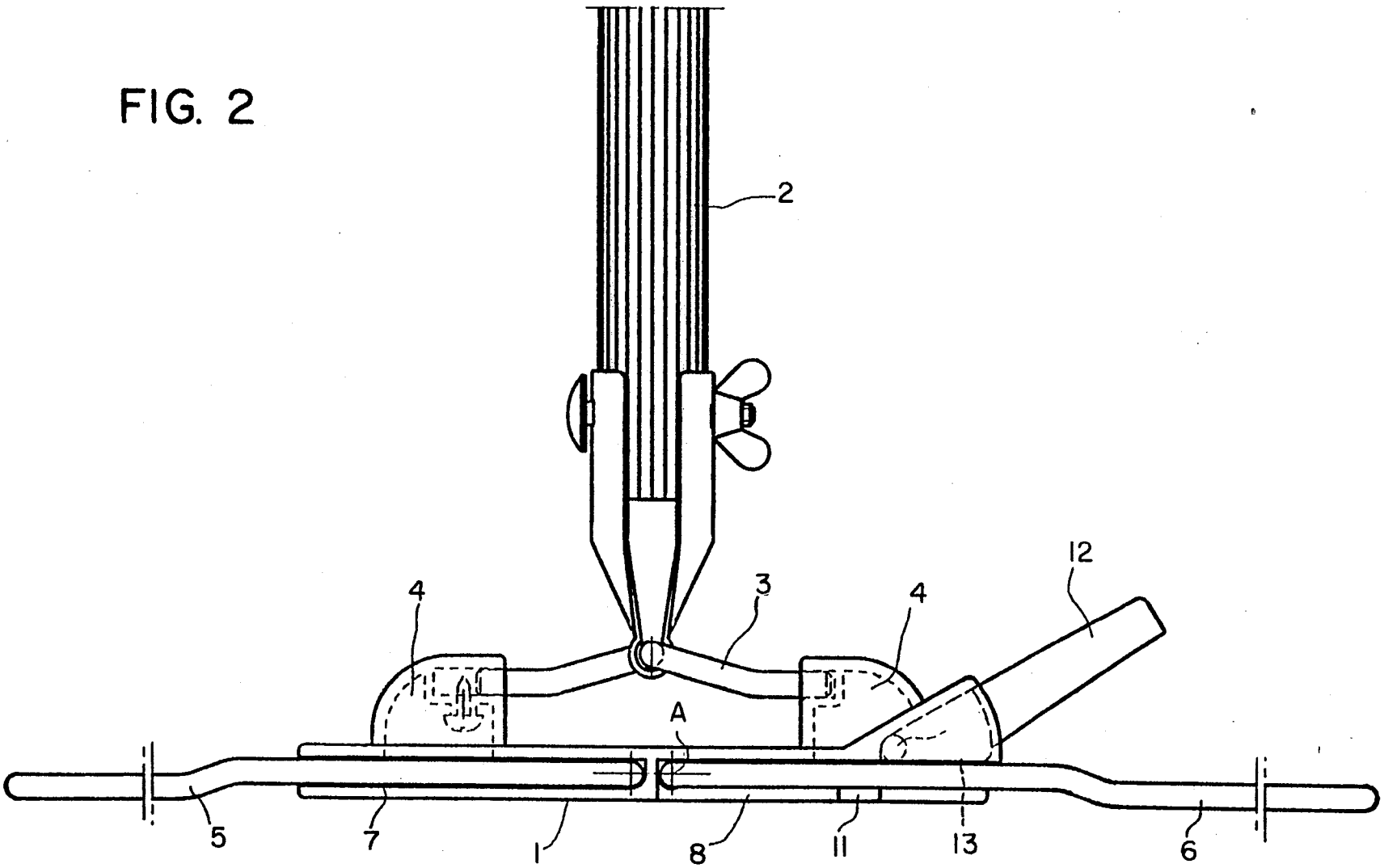
FIG. 2 is a side view.
Figure 3:
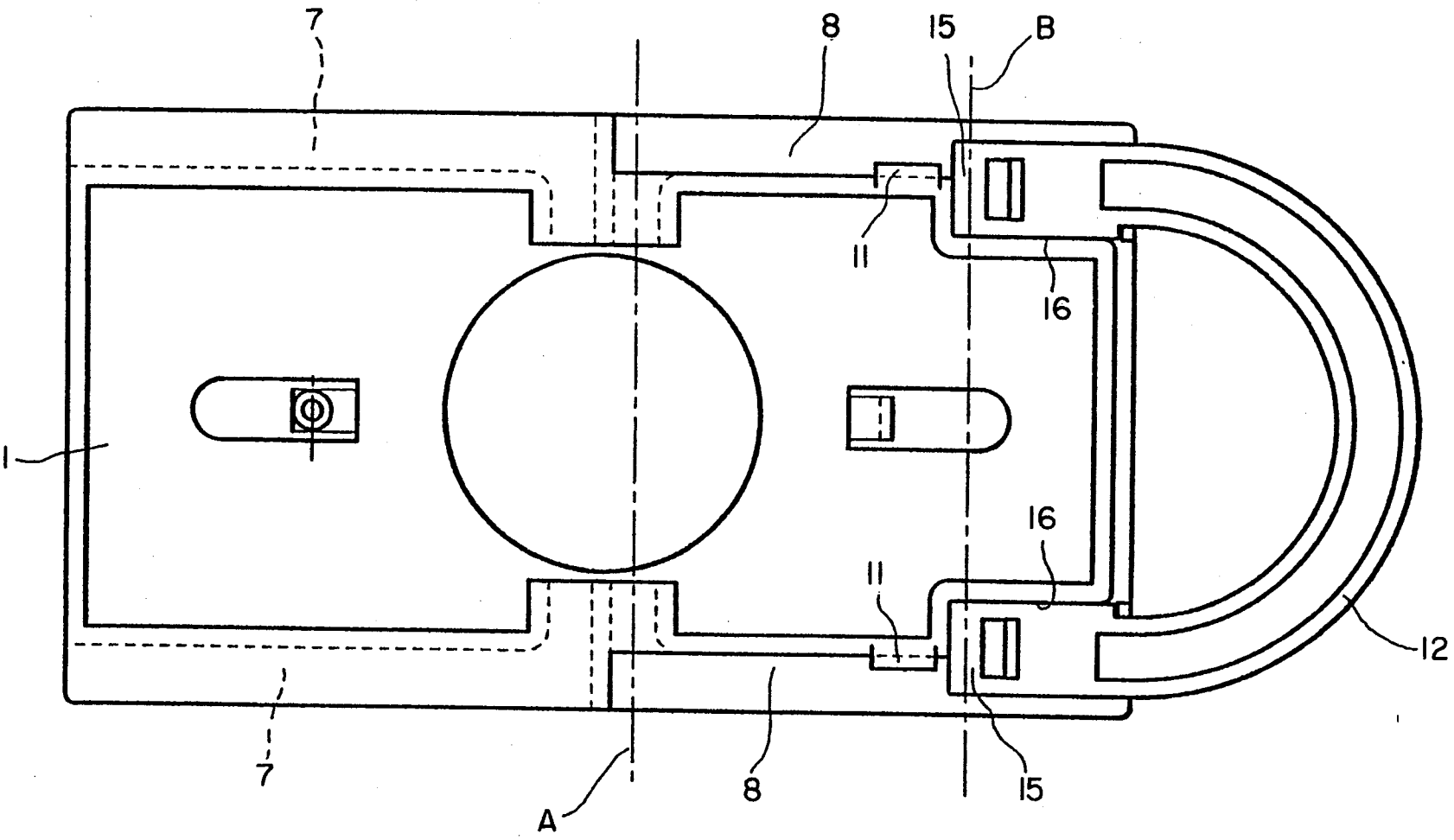
FIG. 3 is a view of the carrier plate from below.

The floor mop shown in FIGS. 1–4 has a carrier plate 1, to the top of which a handle 2 is secured for universal movement, similar to a universal or a cardan joint. The joint has a shaft 3 supported in yokes 4. Two generally U-shaped frame parts 5 and 6 are mounted on the carrier plate 1. The frame parts 5 and 6 can be inserted into the pockets 21 (FIG. 5) on the ends of a changeable cover 20. The two frame parts 5 and 6 are identical and are bent by 90° at the corners 5*a* and 6*a* of their respective legs. The legs are located in lateral channels 7 and 8, respectively, of the carrier plate 1. Channels 8 are open at the bottom. Blind bores 9 and 10 are located at the ends of the channels and the bent-over ends 5*a* and 6*a* engage these bores. The frame part 6 can be pivoted downward, out of the extended position shown in FIG. 2, about the axis A formed by the ends 6*a*; this is made possible because the channels 8 are open toward the bottom. The channels 7 are closed on the bottom and hence the frame part 5 is not pivotable.

In accordance with a feature of the invention, a U-shaped or bail-shaped lever 12 is provided, which is pivotably supported on the carrier plate 1. Lever 12 is coupled to the frame part 6 to pivot the frame part 6 about an axis B (FIG. 3) parallel to the pivot axis A of the frame part 6. The pivotable frame part 6 is normally held in extended position, in alignment with the longitudinal extent of the carrier plate 1, by a lock formed by extensions, protrusions or projections 11, formed on both sides of the carrier plate 1 in the channels 8.

At a distance from the pivot axis B and from the protrusions 11, the lever 12 contacts the legs of the frame part 6 at engagement point 13, forwardly of axis B. If the lever 12 is pressed downward, then it presses the frame part 6 downwardly, and the locking effected by the protrusions 11 is overcome by resilient spreading apart of the legs of the frame part 6. A changeable cover 20 slipped onto the frame parts 5, 6 can now be removed and replaced.

For pivotably supporting the lever 12, the carrier plate 1 is provided with receptacles 14 (FIG. 4) which are open toward the bottom and into which bearing bolts 15 formed onto the ends of the lever 12 are clipped. The axes of the bearing bolts 15 define the pivot axis B. The carrier plate 1 has recesses 16, open at the bottom, for receiving the ends of the lever 12. The oblique upper walls 17 of the recesses 16 serve as stops for the lever 12 when the frame part 6 is in the non-actuated, flat state, as can be seen from FIG. 4.

The carrier plate 1 and the lever 12 are preferably of plastic and the frame parts 5, 6 are preferably of metal. As can be seen, the lever 12 and the frame parts 5, 6 are joined to the carrier plate 1 by simple snap connections, thus making for extremely simple assembly.

OPERATION

When the floor mop is to be provided with a cover, the user steps on the lever 12, causing the frame part 6 to pivot downwardly, overcoming the locking effect provided by the protrusions 11. The cover can now be slipped onto the frame parts 5, 6 by its end pockets 21. The frame part 6 is then folded back again over stops 11, by resiliently spreading frame 6, which tightens the cover. The lever 12 is simultaneously returned to its outset or rest position of FIG. 4 by its engagement with the frame part 6.

Figure 5:
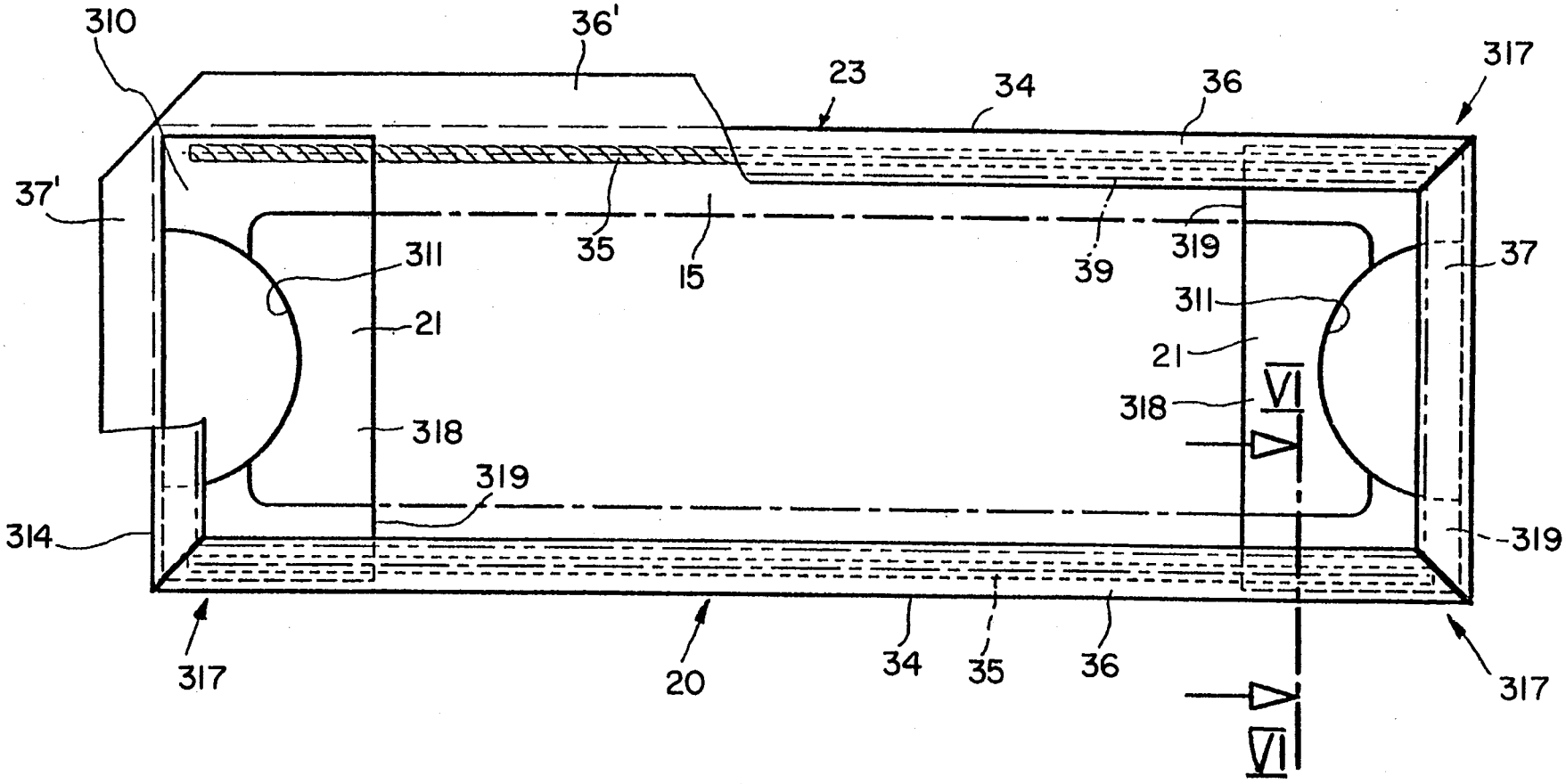
FIG. 5 is a plan view of a changeable cover with its edge folded partway open.

FIG. 5 shows a changeable cloth cover 20 for the floor mop shown in FIGS. 1–4; it can also be used for other mops of this general type. It is rectangular in form and comprises an absorbent material, based on a backing 32 (FIG. 6) with pile threads 33. On its ends, pockets 21 (FIG. 5) are provided on top; the frame parts 5, 6 of the floor mop can be inserted into these pockets. The lengthwise edges 34 of the cloth cover are provided with reinforcements 23, which in the exemplary embodiment are formed by plastic wires or round bars or cord inlays 35 stitched into the folded-over lengthwise edges 36. For clear illustration, one lengthwise edge portion 36' and one crosswise edge portion 37' are shown folded up in order to illustrate the shape of the pattern of the backing 32 clearly and to make the parts located under the folded-over edges visible.

The cloth cover 20 has one pocket 21 on each of its ends, on the top. In accordance with a feature of the invention, the pockets each are formed by a molded plastic part and intended to receive the ends of the clamping frame 5, 6 of the floor mop. Naturally the pockets may also be made from a fabric element, in the known manner. The edges of the pockets 21 may be secured to the backing 32 by the seam 39 (FIG. 6) which joins the lengthwise edges 36 to the backing 32. However, they can also be stitched separately to the backing. To make it easier to wring out the wet cloth cover, the edges 310 of the pockets toward the Crosswise edges 37 of the cloth cover are provided with a relatively deep cutout 311, making these pockets approximately U-shaped in plan view.

Figure 6:
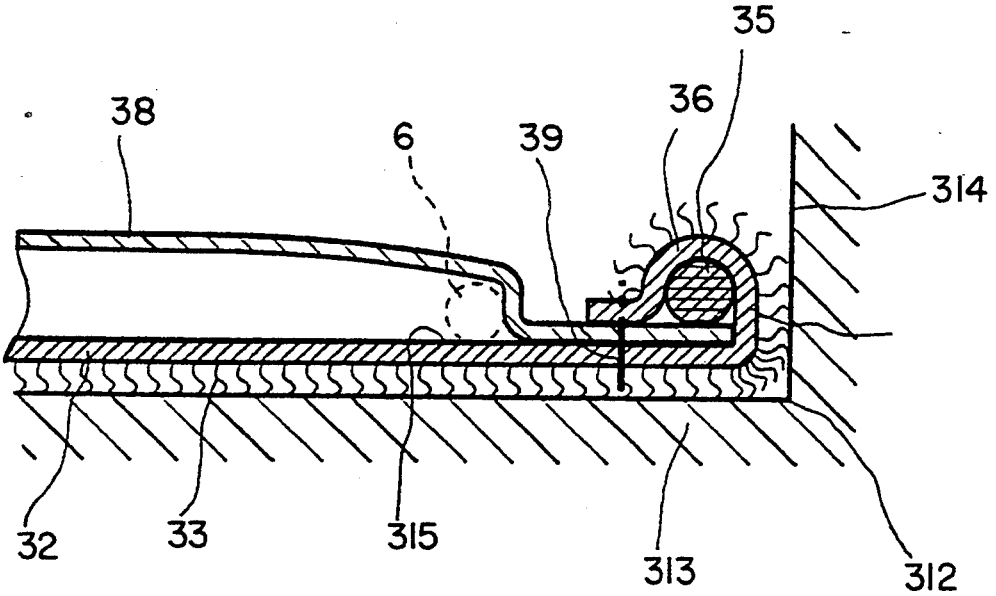
FIG. 6 is a section taken along the line VI—VI of FIG. 5.

The plastic wires 35 stiffen the lengthwise edges 36 of the cloth cover 20 in such a way that, as can be seen from FIG. 6, the corner 312 between the floor 313 and the wall 314, or a baseboard attached to it, can be reached and cleaned, and crumpling of the upwardly extending part 34 of the lengthwise edge 36 is avoided. The width of the reinforced lengthwise edges 36, that is, the spacing of the lengthwise edges 34 from the bearing plane 315 of the frame 5, 6, that is, effectively the plane of the backing 32, amounts to only a maximum of 3 cm, so that bending upward of the edge as the floor mop is guided along the wall, which would mean that the corner 312 would not be properly reached, is avoided. The corners of the pockets 21, as can be seen from FIG. 1, extend into the corners of the cloth cover 20, so that these corners as well, and at the same time the crosswise edges 37 of the cloth cover are reinforced.

Figure 7:
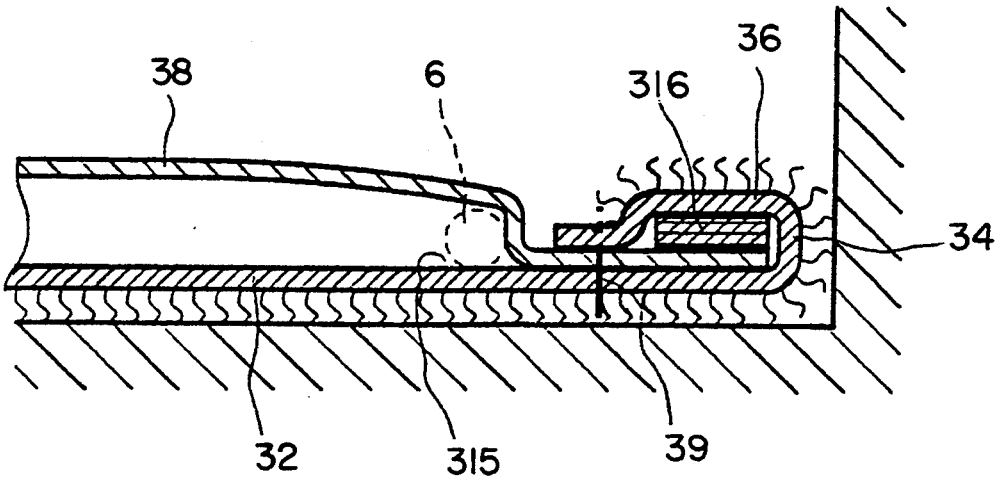
FIG. 7 is a section similar to FIG. 6 of a second exemplary embodiment.

In the exemplary embodiment of FIG. 7, a flexible plastic strip 316, instead of a plastic wire, is provided along each lengthwise edge 34 of the cloth cover. This strip, like the wire 35 in FIGS. 5 and 6, is held by the folded-over and stitched lengthwise edge 36.

Optionally, the seam 39 may also be extended through the strip 316. The pockets 21 are secured as in the first exemplary embodiment.

Figure 8:
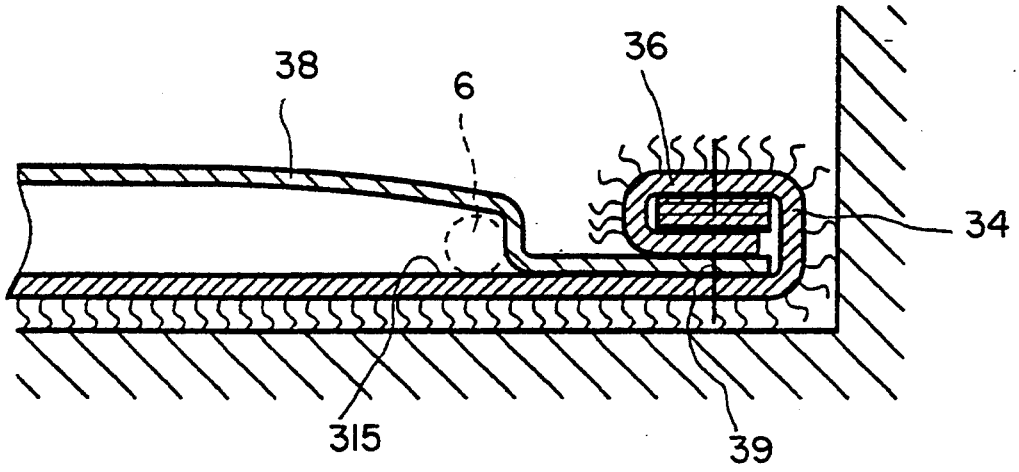
FIG. 8 is a section similar to FIG. 6 of a third exemplary embodiment.

In the exemplary embodiment of FIG. 8, the reinforcement of the lengthwise edges 36 is attained by folding the edges 36 over twice and stitching them to the backing 32. By thus folding them over twice, the binding of the edge which is otherwise necessary to prevent raveling of the edge can be omitted. Once again, the pockets 21 can be stitched in simultaneously with the rest.

Figure 9:
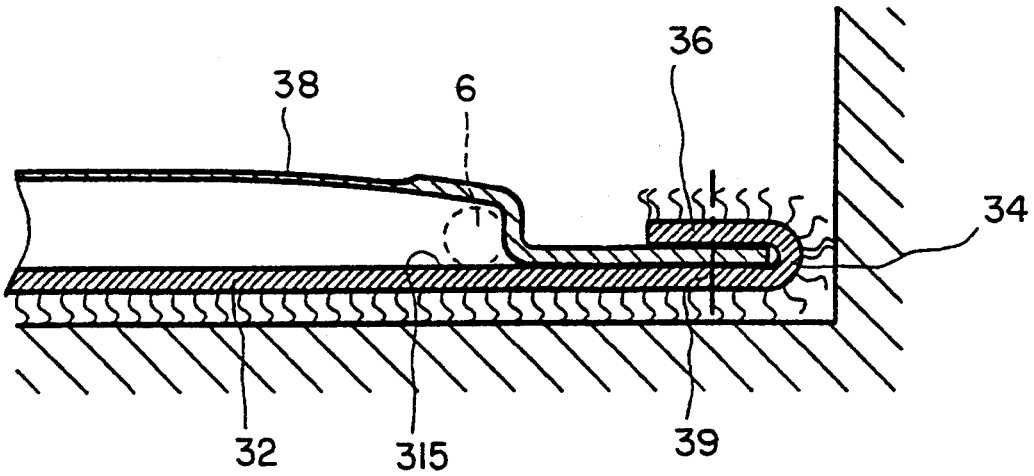
FIG. 9 is a section similar to FIG. 6 of a fourth exemplary embodiment.

In the exemplary embodiment of FIG. 9, the reinforcement is done only by means of the pockets 21 in the corner regions 317. Further stiffening of the edge as in the preceding exemplary embodiments is dispensed with entirely. It has been found in practice that the tension of the clamping frame 5, 6, in cooperation with the reinforcements in the corner region, is entirely adequate.

The embodiment of the pockets 21 as molded plastic parts has proved to be especially advantageous, from several standpoints. Because of the possibility of profiling, especially easy introduction of the clamping frame 5, 6 is assured. Different wall thicknesses, as where the middle region 318 (FIG. 5) is markedly thinner in wall thickness than the encompassing corner region 319, makes possible a high contact force of the cloth cover 20 with the floor and in corners possible, on the one hand, and, on the other, permits easy wringing out of the cloth cover 20. Naturally the pocket can be sewn or adhesively bonded or welded to the cloth cover 20. Nevertheless, to avoid damage to vulnerable furniture, it is advantageous to fold the cloth cover 20 over the edge 319 of the pocket and thus to cover the plastic region completely.

Various changes and modifications may be made and any features described herein with respect to any one embodiment may be used with any others, within the scope of the inventive concept.

I claim:

1. A floor mop, adapted to receive a removable cover (20), comprising a carrier plate (1);

two generally bail-like frame parts (5, 6) of essentially U shape, having legs extending along the carrier plate (1) for receiving the removable cover;

means (**6*a*, 10) for pivotably supporting one frame part (6) on the carrier plate for pivotable movement about an axis (A) extending transversely to said carrier plate between an extended position, essentially parallel to said carrier plate, and a raised position, at an angle thereto; and locking means (11) constraining said movable frame part (6) in an extending position on said carrier plate (1), comprising a lever (12) pivotable mounted on the carrier plate (1) and engaging the pivotable frame part (6) for pivoting the pivotable frame part out of its extended position and overcoming the locking effect of the locking means (11) to permit release of the removable cover from said frame parts (5, 6); and wherein the locking means for the pivotable frame part (6) is formed by protruding means (11) on the carrier plate (1), cooperating with the legs of the movable frame part, the legs of said movable frame part being spread apart upon movement of the lever (12), thereby overcoming the locking effect of said locking means (11**).

2. The mop of claim 1, wherein the pivot means comprises bent-over free ends (**6*a*) of the legs of said pivotable frame part (6) by 90°, said bent-over free ends engaging blind bores (10) formed in the carrier plate (1**).

3. The mop of claim 2, wherein both frame parts (5, 6) are essentially identical;

first guide channels (7) located at side surfaces of said carrier plate (1) and closed laterally outside of the plate are formed in said carrier plate and guide the legs of the non-pivotable frame part; and second guide channels (10) located at side surfaces of said carrier plate (1) open laterally outside of the plate are formed on said carrier plate, said movable frame part (6) being located in said outwardly open channels and guided therein when in the extended position.

4. The mop of claim 1, wherein the lever (12) is pivotable about a pivot axis (B) extending parallel to said axis (A) of the pivotable frame part (6), and wherein said lever is operatively coupled to said pivotable frame part at positions (13) spaced from said pivot axis (B) and from said locking means (11).

5. The mop of claim 4, wherein said carrier plate (1) is formed with guide channels (8) open towards the bottom of said guide plate;

the legs of said movable frame part (6) are located and guided in said guide channels (8);

the carrier plate is further formed with an oblique, upwardly extending wall portion (17);

the lever (12) extends upwardly from the carrier plate (1), is located, in part, beneath said oblique wall portion (17) and is formed with spaced projecting means (14) extending downwardly towards the carrier plate; and laterally projecting bearing bolts (15) are provided on said lever, located between said spaced projecting means which form a receptacle for said bolts, said bolts forming a lever axis congruent with said pivot axis (B).

6. The mop of claim 1, wherein the lever is shaped, in plan view, in essentially U or bail configuration and is pivotably coupled to the carrier plate (1).

7. The mop of claim 6, wherein the carrier plate (1) is formed with recesses (16) open towards the bottom to receive end portions of the essentially U-shaped lever (12); and wherein upper walls (17) of the recesses extend obliquely upwardly and form stops for the lever to retain the lever in position when the pivotable frame part (6) is in aligned position with the carrier plate (1).

8. The mop of claim 1, wherein the carrier plate (1) and the lever (12) are made of plastic;

said frame parts (5, 6) are made of metal; and wherein the lever (12) and said frame parts are coupled to the carrier plate (1) by snap-together connections.

9. The combination of the mop of claim 1, with a removable cover (20), wherein the cover has longitudinal edges extending essentially parallel to the legs of the frame elements (5, 6);

wherein the cover has a receiving surface (315) adapted for engagement with said frame parts (5, 6);

and wherein the longitudinal edges of said cover (20) include reinforcement means (23).

10. The combination of claim 9, wherein the reinforcement means (23) include sewn-in cords.

11. The combination of claim 10, wherein the reinforcement means comprise flexible plastic members (35).

12. The combination of claim 9, wherein said reinforcement means comprise flat plastic strips (316).

13. The combination of claim 9, wherein the reinforcement means comprise flexible plastic wire elements.

14. The combination of claim 9, wherein said longitudinal edges of the cloth cover (20) are folded over the reinforcement means (23, 35, 38, 316).

15. The combination of claim 14, wherein the folded-over edge is secured to an underlying portion of said cover by stitches.

16. The combination of claim 9, wherein the longitudinal edges (36) of the cloth cover (20) are folded inwardly twice, and the double fold is then seamed, said double fold seam forming said reinforcement means.

17. The combination of claim 9, wherein the reinforcement means extend longitudinally and are located closely adjacent said receiving surface (315).

18. The combination of claim 9, further including pockets (21) adapted to receive said frame parts (5, 6); and plastic molded parts extending into the corners of the cover, said cover comprising textile material.

19. The combination of claim 18, wherein said plastic molded parts forming the pockets (21) are formed with cutouts (311).

20. The combination of claim 18, wherein said plastic molded parts have regions of varying thickness across a dimension essentially parallel to said axis (A) to provide flexibility for said cover.

21. A removable cover, adapted for assembly with a mop, optionally the mop as claimed in claim 1, wherein said removable cover comprises textile material shaped to define two essentially parallel longitudinal edges, and pockets (21) at end portions, connecting said longitudinal edges, said cover including stiffening means (23) extending along said longitudinal edges.

22. The cover of claim 21, wherein said stiffening means comprises at least one of: cords, sewn into folded-over edge portions, flexible plastic elements (35) secured to said edge portions, and multiple layers or plies, formed by multiple folding-over of said edge portions and securing said folded-over edge portions together.

23. The cover of claim 21, wherein said cloth cover (20) has a backing surface (315) adapted to be fitted against a mop structure, optionally the mop of claim 1, and wherein the stiffening means are located immediately adjacent the lateral side of the backing surface (315).

24. The cover of claim 21, wherein the pockets (21) of the cover include plastic molded elements extending up to the corners of the textile material of the cover (20).

* * * * *